United States Patent [19]

Vernon

[11] Patent Number: 4,867,421

[45] Date of Patent: Sep. 19, 1989

[54] FENCE POST

[76] Inventor: Kenneth O. Vernon, 1642 Alana Pintado, Solvang, Calif. 93463

[21] Appl. No.: 912,256

[22] Filed: Sep. 29, 1986

[51] Int. Cl.[4] ..... E04H 17/10

[52] U.S. Cl. ..... 256/54; 256/47; 256/35; 256/DIG. 5; 52/364

[58] Field of Search ..... 256/47, 54, 56, 55, 256/2, 10, 21, 68, DIG. 5, 65, 70, 35, 48; 52/377, 373, 364

[56] References Cited

U.S. PATENT DOCUMENTS

| | | | |
|---|---|---|---|
| 451,461 | 5/1891 | Darnell | 256/35 |
| 762,902 | 6/1904 | Haines | 52/364 |
| 772,662 | 10/1904 | Mallory | 52/364 |
| 862,928 | 8/1907 | Myers | 256/47 |
| 1,187,280 | 6/1916 | Dodds | 256/55 |
| 1,190,749 | 7/1916 | Freeze | 256/48 |
| 1,195,760 | 8/1916 | Young | 256/55 |
| 1,360,375 | 11/1920 | Dammann | 256/54 |
| 1,454,649 | 5/1923 | Murton | 256/47 X |
| 1,477,349 | 12/1923 | Hindmarsh et al. | 256/47 |
| 2,396,512 | 3/1946 | Johnson | 256/10 |
| 2,630,890 | 3/1953 | Macomber | 52/377 |
| 3,022,044 | 2/1962 | Gugino | 256/47 |
| 3,161,263 | 12/1964 | Stokes | 256/47 X |
| 3,214,875 | 11/1965 | Slovinski et al. | 52/364 |
| 3,282,005 | 11/1966 | Birdwell | 52/364 |
| 3,332,189 | 7/1967 | Blatnik | 52/364 |
| 3,775,924 | 12/1973 | McClure, Jr. | 256/47 |
| 3,807,089 | 4/1974 | Senese | 256/47 X |
| 3,985,343 | 10/1976 | Sasena | 256/47 |
| 4,119,302 | 10/1978 | Moroco et al. | 256/DIG. 5 X |

FOREIGN PATENT DOCUMENTS

| | | | |
|---|---|---|---|
| 2516144 | 5/1983 | France | 256/47 |
| WO84/02944 | 8/1984 | PCT Int'l Appl. | 256/47 |

*Primary Examiner*—Peter M. Cuomo

*Attorney, Agent, or Firm*—James E. Hawes

[57] ABSTRACT

A triangular fence post is disclosed which includes a longitudinal slot in one side formed by two inturned flanges, the spacing of the slot being less than the width of a fastener, the inner ends of the inturned flanges being turned towards one another to bite into a fastener driven into the slot. Because of this construction, the clamping action of the flanges and the bite of their inner ends cooperate to securely hold the fastener to the fence post, irrespective of the extent of penetration by the fastener into the slot beyond the flange ends. This arrangement enables any of various types of fasteners to securely hold any gauge of wire or wires in any desired state of tension, or even to hold boards if desired.

10 Claims, 3 Drawing Sheets

FENCE POST

BACKGROUND OF THE INVENTION

1. Field of the Invention

The present invention pertains generally to posts, more particularly to posts that are to be driven into the ground for supporting, for example, one or more horizontal strands of wire so as to construct a fence, and especially to longitudinally slotted tubular post of triangular cross section.

2. State of the Prior Art

Metallic fence posts have been in common use for many decades. Likely, they were developed to achieve a more durable fence than can be had using traditional wooden posts. Examples of early metallic tubular fence posts are found in U.S. Pat. No. 296,070 to Rutz, U.S. Pat. No. 319,277 to Lesher and U.S. Pat. No. 620,950 to Morgan. More recent fence posts are shown in U.S. Pat. No. 3,161,263 to Stokes, U.S. Pat. No. 3,305,985 to Dean and U.S. Pat. No. 1,202,988 to Freeze.

More pertinent to the present invention are the structure set forth in U.S. Pat. Nos. 1,791,331 to Sollenberger, 1,477,349 to Hindmarsh et al. and in U.S. Pat. No. 772,662 to Mallory. The first two of these references show tubular posts fashioned of sheet metal having longitudinal slots for receiving fasteners such as U-shaped staples which may be used to secure wire fence strands to the post. In the case of the Mallory reference, the staples are intended to secure dry wall panels or equivalent wall covering material rather than fence wires, to the post structure. However, if the Sollenberger structure can be fabricated, which is doubtful because of the overturned wire flange within the tubular post, the fastener is held solely by whatever clamping force is exerted by the overturned flange. In the Hindmarsh et al. structure the staple is held in place solely by an interlocking of the slot edges in the post with the grooves in the staple; there is no substantial clamping action of the post on the staples. The Mallory metal stud, being intended to support rigid drywall panels is designed receiver with slots which fasteners that make only point contact with the slot edges. While this may be adequate where sheet material is stapled to the stud, it is not sufficient for holding wire or a small panel, or indeed an thing which does not substantially support or stabilize the staple.

Metal fence posts are exposed to extreme variations in outdoor temperature, ranging from below freezing to well above 100 degrees F., inducing severe expansion and contraction cycles of the fence post material and the fasteners held therein, which for such design as previously described commonly lead to loosening and eventual loss of the wire staples. This process is aggravated by loading of the post and wires by livestock and similar forces. A continuing need therefore exists for low-cost metal posts of sturdy, readily manufactured construction capable of holding fasteners securely and dependably over the seasons against the various loads commonly applied to them.

SUMMARY OF THE INVENTION

The present invention provides a tubular metal post of triangular cross section that can be easily fabricated of sheet material, such as steel. It is longitudinally folded to form three sides and two inwardly extending normally spaced apart flanges, one of the three sides being longitudinally divided by a continuous slot defined between the two inturned flanges. The flanges each terminate in an inner flange end, the two flange ends being spaced apart so that the slot opens into the hollow interior of the post.

The novel post is intended for use with U-shaped serrated wire staples, serrated ring nails, smooth shank nails or screws, among other possible fasteners. The shanks of the fasteners are wedged within the slot and gripped between the opposing faces of the two flanges.

Two embodiments of the triangular post of this invention are disclosed.

In the presently preferred embodiment of the invention, the inturned flanges are substantially parallel to one another, each terminating in an end portion that is slightly bent each towards the other so as to present relatively sharp edges pressing against the fastener shanks. When a staple or nail is driven into the slot, the inner edges of the flange bite into the fastener shank, while the parallel face portions of the flanges clamp against the fastener shank along opposed sides. The bite secures the fastener against axial withdrawal of the fastener from the slot, while the axially spaced clamping action prevents any lateral wiggling movement of the fastener within the slot. Thus, longitudinal displacement of the fastener along the slot is substantially prevented by the combined clamping effect of the flange edge bite and the clamping flange portions. If the fastener has a notched or serrated shank, the inner flange edges will fit into the notches (termed a "companion fit") and assist in tightly holding the fastener to the post.

In an alternate embodiment of the post, the inturned flanges are planar, mutually parallel and perpendicular to the divided side of the post, and the fastener is gripped by resilient clamping force between the full faces of the flanges. Thus, line contact exists between the fastener shank and each opposing flange face along substantially the entire width of each flange.

The post preferably is provided with spacer slugs fixed as by welding between and to the inturned flanges at longitudinally spaced intervals so as to limit the deformation of the slot due to twisting of the post or the like, which in turn assures the secure retention of a sufficient number of staples or other fasteners. Such spacer slugs also enable a removable spade to be attached to the post to stabilize and secure the post in loose or sandy soil. Fence posts with spades are well known, but the spade has always been permanently affixed to the post as by welding or the like. Thus, while it was possible to obtain posts with or without spades, prior art metal post designs are not adapted to accepting a field installable spade. In a preferred embodiment, the spade includes appropriate fasteners such as slugs, which cooperate with one of the spacer slugs affixed in the post slot, the post slug serving as a positive stop element to prevent the spade from sliding upwardly along the post slot as the post and spade assembly is driven into the ground.

These and other advantages of the present invention will be better understood from the following detailed description of the preferred embodiments as shown in the attached drawings.

DETAILED DESCRIPTION OF THE PREFERRED EMBODIMENT

Figure 1:
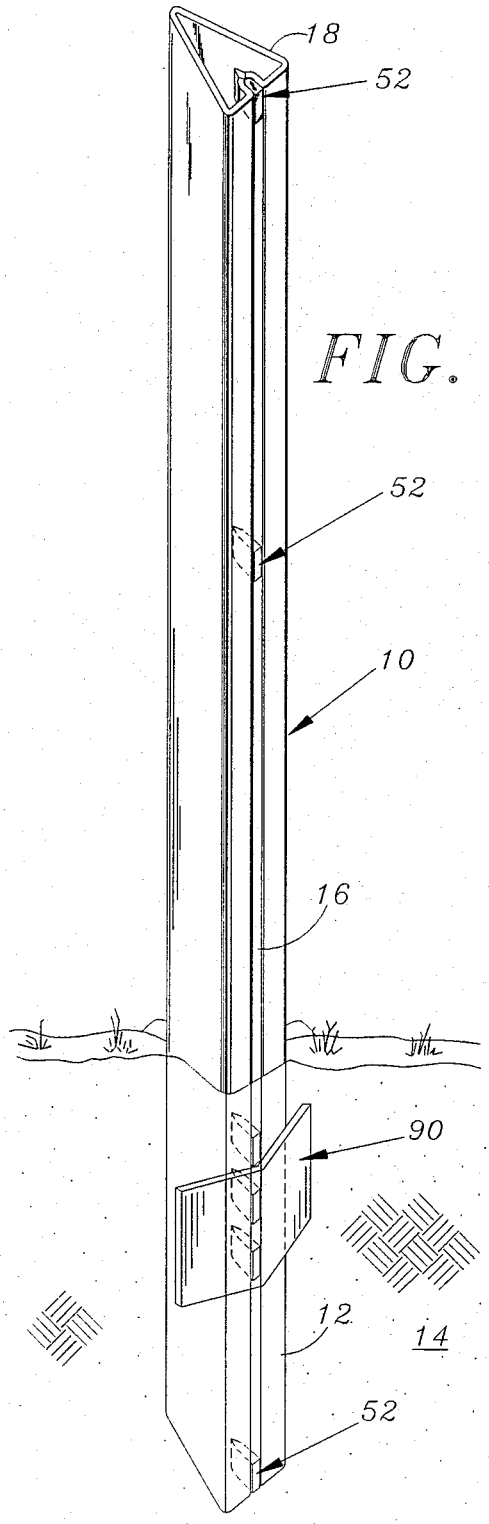
FIG. 1 is a perspective view partially in crosssection, of a preferred embodiment of the novel post provided with spacer slugs and equipped with a spade attachment.
Figure 2:
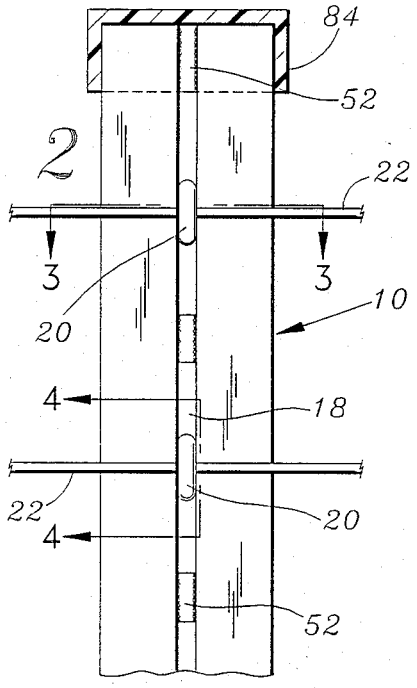
FIG. 2 is a side elevational partial view of the post of FIG. 1 with two wire strands secured thereto by staples driven into the post.

With reference to the drawings, FIG. 1 shows a preferred embodiment of the metal post 10 of the present invention with its lower end 12 driven into the ground 14. A longitudinally extending slot 16 runs the full length of the post 10 between its upper end 18 and the lower end 12. As shown in FIG. 2, fastener 20 may be inserted in slot 16 to attach a strand of fence wire 22 to the post. The post, shown in cross-section in FIG. 3 includes two sides 24 joined at a common angle or corner 26, and a third post side 28 divided lengthwise into two equal halves by longitudinal slot 16 defined between two inturned flanges 30. Since in many applications the fence posts will be subjected to forces transverse to the run of the fence, forces that are significantly greater than the forces exerted along the run of the fence, the length of side 24 of the post may be increased relative to side 28 to provide a post which, in transverse section, is shaped like an isosceles triangle (as shown, for example, in FIG. 5) thereby providing a post with increased strength in a direction perpendicular to the run of the fence.

The post 10 may be used with any of a variety of fasteners. For example as shown but in FIG. 3 U-shaped staples 20 may be driven into the slot 16 for supporting wire strands 22 to the post. As shown in FIG. 4, the staple 20 has two parallel shanks 36 and the base 38. These shanks may include transverse serrations 40 along at least the shank portions adjacent to the pointed shank ends 42. Both shanks 36 of the staple are driven into the longitudinal slot 16. The thickness of the serrated shanks 36 is slightly greater than the normal spacing between the flanges i.e., greater than the width of the longitudinal slot 18. Thus, as the staple is driven into the slot, the flanges 30 are forced apart by the staple shanks and the faces of the flanges 20 exert a clamping force on the shanks 36 to prevent the staple from wiggling within the slot 16. Accordingly, the wire strand 22 is securely held between the staple base 38 and the outer surface of post side 28.

Figure 3:
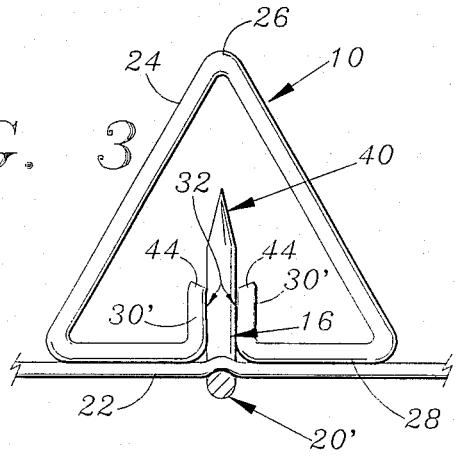
FIG. 3 is a cross-sectional view of of an alternate embodiment of the post.
Figure 4:
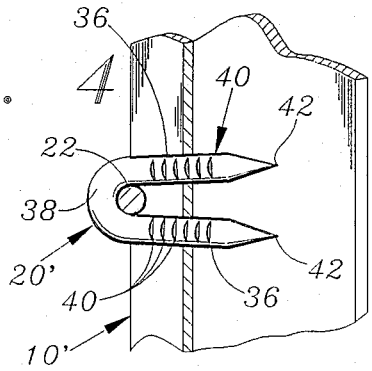
FIG. 4 is a cross sectional view showing a wire staple inserted into the post of FIG. 2.

As shown in FIG. 3 the faces of flanges 30 make substantially line contact with each staple shank 36. Should the shanks include serrations they will tend to frictionally bite into the flange surfaces to further secure the staple in place and prevented from being withdrawn. The clamping or biting force of the post on the staple 20 or other fastener driven into the slot 16 results primarily from a resilient hinging action at corner 26, substantial clamping force can be obtained where the post 10 is made of relatively heavy gauge steel. The triangular cross section of the post is also instrumental in minimizing twisting distortion of the post along its length due to the insertion of fasteners such as staple 20 as compared to prior art cylindrical posts.

Figure 5:
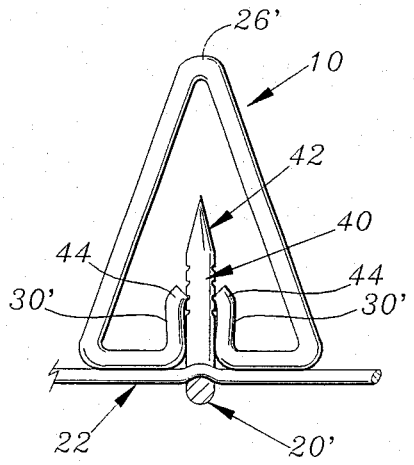
FIG. 5 is a cross sectional view taken along line 5—5 in FIG. 2.

The inner end portions 44 of flanges 30 may be slightly curved in, as shown in FIG. 5 so as to present relatively sharp edges 46. These edges tend to bite into the shank 40 of a staple 20 or other fastener driven between the flanges 30 and into the slot 16. Since the thickness of the fastener shank is slightly greater than the normal width of the slot, the fastener shank 50 is securely held along two opposed sides against lateral movement within the slot 16, while the bite of end portions 44 of the flanges into the sides of the staple secure the fastener against axial withdrawal from the slot 16. By providing serrations in the fastener as shown in FIG. 5, the end portions 44 tend to fit into the staple serrations (termed a companion fit) to lock the staple against withdrawal from the slot.

Figure 6:
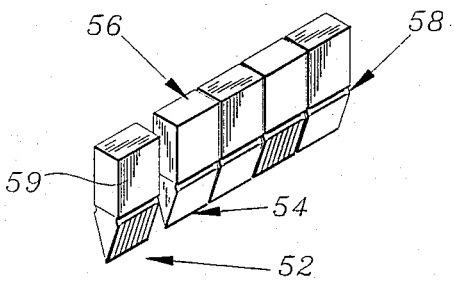
FIG. 6 shows a strip of spacer slugs before separation and individual insertion into and welding to the post of FIG. 1.

Spacer slugs 52, shown in FIGS. 1 and 6, have a wedgelike sharp inner edge 54, a blunt outer end 56, and parallel grooves 58 on opposing side faces 59. Two or more such slug elements 52 may be driven into the slot 16 at longitudinally spaced points, as shown in FIG. 1. If the post is of the construction shown in FIG. 5, the edge portions 44 of the flanges 30 are received into the slug grooves 58 so as to avoid spreading apart the flanges, which therefore remain in their as manufactured spaced apart relationship. The slugs 52 are then preferably welded in place to the post 10. In the preferred embodiment shown in FIG. 1, four spacer slugs are welded in place on each post 10, one at the upper and lower end respectively, one three inches below ground level, and the one midway along the exposed portion of the post. The slug elements 52 limit distortion of the slot width and also prevent any significant twisting or other deformation of the post 10 due to thermal expansion/contraction, or to pressure on the post or fence or to insertion of several staples 20 or other fasteners into the slot 16. Furthermore, the slugs 52 function as stop means welded into slot 16 to limit the possible longitudinal displacement of fasteners and staples 34 along the slot 18.

Figure 7:
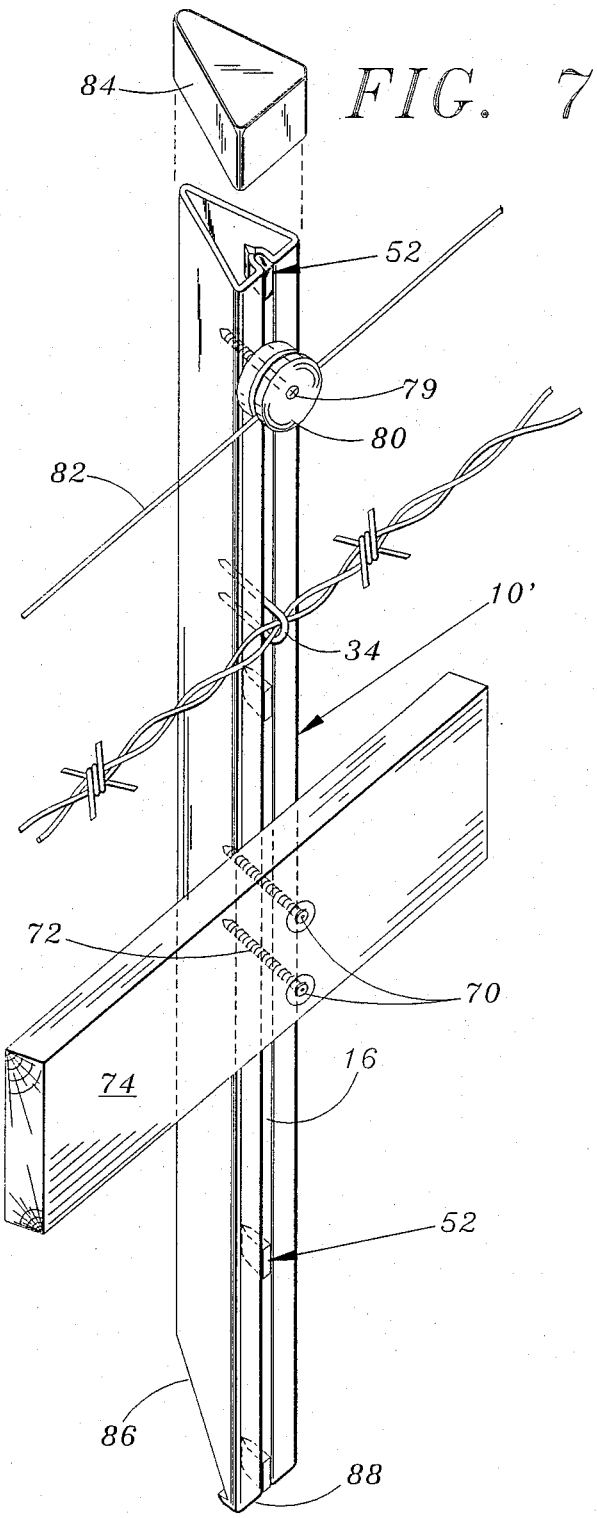
FIG. 7 is a composite perspective view illustrating a variety of fencing materials supported by the post of FIG. 1.

FIG. 7 shows in cross-section a wooden sign 74 nailed to the post of FIG. 1, illustrating use of the novel post as a sign post rather than a fence post. Each nail 70 has a single serrated shank 72 engageable by the flanges 30. Of course, such a post also allows easy nailing of a wooden rail or the like to the fence post, instead of (or in addition to) sign 74, if it is desired to erect a wooden fence.

The post 10 of the present invention accepts a wide variety of fasteners in addition to wire staples 34. While a serrated shank nail 70 is shown, a smooth shanked nail has been found to also work well because as previously stated the flange edges cut into the shank and provide positive gripping action even in the absence of shank serrations, in cooperation with the clamping contact of the opposed flange faces. The post also readily accepts screws, such as sheet metal screws 79 illustrated in FIG. 7 so that, for example, an electrical insulator 80 having a slotted insulator body of electrically insulating material may be attached to the post. An electrically charged wire 82 can then be wound about the insulator body 80 within the slot in a plane passing through the slot transversely to screw 79 so that the wire is supported by the post but is electrically insulated therefrom.

If desired, the top end of the post can be closed by a cap 84 against rain, although this is not essential since water entering the post is discharged through continuous slot 16.

The lower end 86 of the post 10 can be cut at a slant, if desired, as shown in FIG. 7, to provide a sharp lower point 88 for facilitating driving the post into hard packed soil. However, this feature is believed normally unnecessary as the open squared post end advances easily into the ground.

Figure 8:
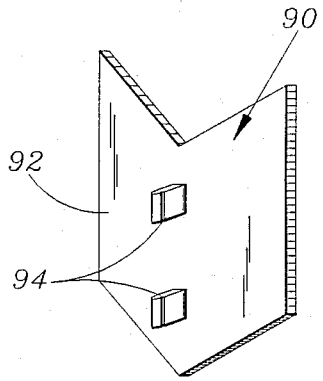
FIG. 8 is a perspective view of a spade attachment for the post of FIG. 1.

As shown in FIG. 1, the post 10 may be provided with a spade attachment 90 for supporting and stabilizing the post in loose or sandy soil. The spade, shown in FIG. 8, has a rigid spade sheet 92 which may be planar and somewhat arrow-head shaped to facilitate ground penetration. Two or more slug elements 94 are formed in (or welded onto) the spade sheet 92. The spade 92 can then be attached to a post 10 by driving the attached spade slugs 94 into the slot 16. The slugs 94 are retained between the post flanges 30, as has been explained, thus holding the spade sheet to the post. As the post is then driven into the ground 14 the spade 90 is stopped against upward sliding movement along the slot 18 by engagement of the uppermost spade slug 92 with the first adjacent spacer slug 52 welded to the post. There is consequently no need to permanently affix the spade 90 to the fence post, and any given post 10 can be readily provided with a spade 90 in the field during fence construction as ground conditions demand. The possibility of field installation of the spade greatly facilitates packaging and shipment of the posts, since separate posts and spades can be shipped more compactly and economically. There is also greater latitude in stocking an inventory of fencing material since spades can always be fitted to posts and there is no need to anticipate precise numbers of spaded or unspaded posts that may be required for a particular job.

Figure 10:
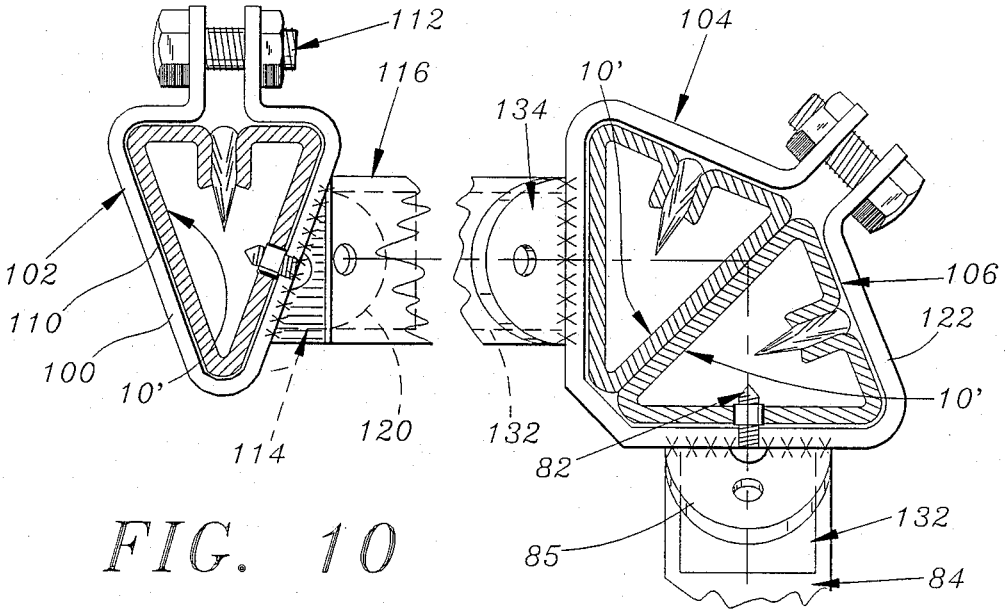
FIG. 10 is a cross sectional view showing both a single-post clamp mounted to a post and a double-post corner clamp mounted to a pair of posts.
Figure 9:
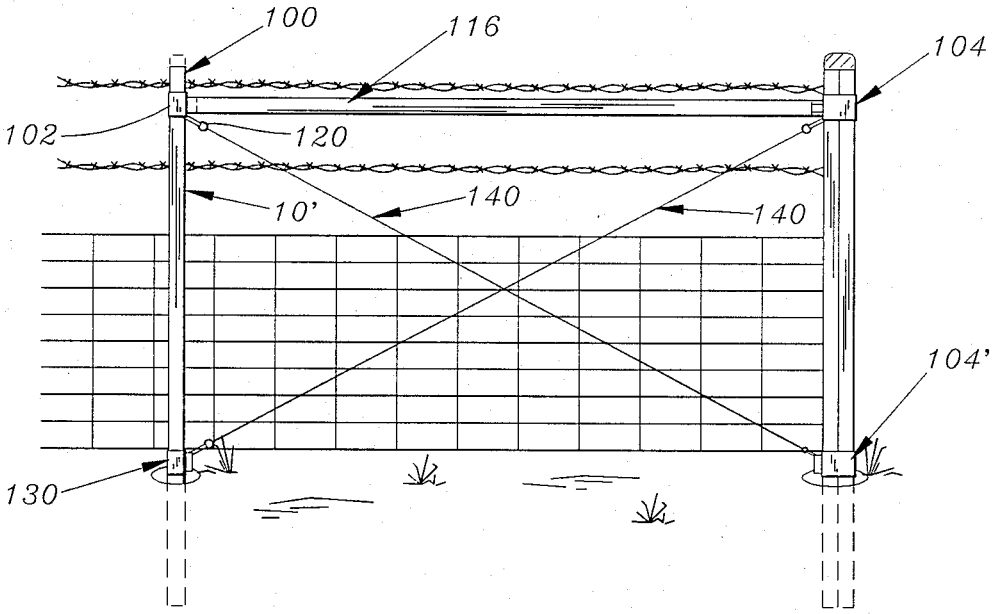
FIG. 9 is a side elevational view of a fence corner brace constructed with novel clamps according to this invention.

FIG. 9 shows a presently preferred system for bracing a fence corner or a fence gate, the fence being constructed with posts such as have been described above. The next to last post 100 at the fence corner is fitted with clamps 102 near the top and bottom respectively, while the corner post 104 is a double post fitted with corner clamps 106 as shown in FIG. 10. Each clamp 102 has a collar band 110 slidably encompassing the post 10, a screw clamp arrangement 112 for tightening the band 110 around the post to fix it in place, and a male projecting coupling or stub 114 which receives the open end of a tubular compression rail 116, seen best in FIG. 9; thus attaching the tube 116 to the post 10 as shown. A guy wire anchor lug 120 is welded to the band 122 beneath the coupler 102, as shown in FIG. 9. Thus, when the collar is slipped on the post 10, the lug 120 can be disposed above or below the stub 114, and the same clamp unit 102 can be used at the top of one post and at the bottom of another post by reversing the clamp. The lower clamp 170 is inverted on the post so that the guy wire lug is above the stub 120, while the upper clamp is mounted to the post with the lug 120 below the coupler 116. The corner brace 106 has similar elements, except that it is shaped to encompass two posts 10 set face to face, as shown in FIG. 10, and has two stubs 132 and lugs 134 on two brace faces at right angles as shown in FIG. 10. The posts are guyed to each other by tension wires 140 and maintained in spaced relationship by tension bar 116 as seen in FIG. 10.

Particular embodiments of the invention have been shown and illustrated by way of example only and for purposes of clarity and explanation; various changes, substitutions and modifications will be apparent to those possessed of ordinary skill in the art without departing from the spirit and scope of the invention thus, the invention is defined by the following claims.

What is claimed is:

1. A fence post comprising a tubular channel, the channel having two longitudinally extending inturned normally spaced apart flanges defining therebetween a continuous slot in said channel, said flanges extending from a slot entry at one side and terminating each at an inner flange end, said inner flange ends being slightly turned towards each other, said continuous slot being open to the interior of the post for receiving fasteners of cross sectional with greater than the spacing of said inner flange ends, said flanges having opposed flange faces concavely curved intermediate said slot entry and said inner flange ends, said inner flange ends being formed to present relatively sharp edges for biting into a fastener driven between said flanges, said flanges also having convexly curved gripping surfaces near said slot entry for holding the fastener against lateral movement within said slot, said fasteners being received between said flanges and retained therebetween by clamping action resulting from resilient spreading apart of the tubular post and by their engagement with the inner ends of the flanges.

2. The post of claim 1 further comprising a plurality of spacer slug means fixed between and to said flanges at longitudinally spaced locations for preventing twisting of the post and limiting distortion of said slot due to insertion of fasteners therein.

3. The post of claim 1 wherein said channel is of triangular cross section, one of said sides being divided by the continuous slot formed by said spaced apart flanges, and wherein said fasteners are retained between said spaced apart flanges by clamping action resulting from resilient spreading apart of the other two sides of the triangular channel at their common juncture, said common juncture being diametrically opposite said slot.

4. A fence post as set forth in claim 3 wherein said one side of the triangular cross section is shorter than the other two sides whereby said cross section is an isosceles triangle, so as to increase the load resistance of the post in the direction perpendicular to the base of said isosceles triangle in relation to its load resistance in a direction parallel to said base.

5. A fence post as set forth in claim 1 in which the tubular channel is formed to have a triangular cross section, one of said sides having said two longitudinally extending inturned normally spaced apart flanges formed therein.

6. A fence post as set forth in claim 5 in which the tubular channel of triangular cross section is formed of a single folded sheet of uniform thickness.

7. A fence post as set forth in claim 1, including means to fix said flanges in a predetermined, spaced relationship to one another, whereby deformation of the slot defined by the spaced apart flanges is limited.

8. A fence post comprising a three sided tubular channel of triangular cross section, one of said sides having two longitudinally extending inturned normally spaced apart flanges defining therebetween a continuous slot dividing said one slot, said flanges extending from a slot entry at one side and terminating each at an inner flange end, said inner flange ends being slightly turned towards each other, said slot being open to the interior of the post for receiving fasteners of cross sectional width greater than the spacing of said normally spaced apart flanges, said fasteners being received between said flanges and retained therebetween by clamping action resulting from resilient spreading apart of the other two sides of the post at their common juncture and by their engagement with the inner ends of said flanges, said flanges having opposing flange faces concavely curved intermediate said slot entry and said inner flange ends, said inner flange ends presenting relatively sharp edges for biting into said fasteners driven between said flanges, said flange faces also having convexly curved gripping surfaces near said slot entry for holding the fasteners against lateral movement within said slot; and a plurality of spacer slugs fixed between and to said flanges at longitudinally spaced locations for preventing twisting of the post and limiting distortion of said slot due to insertion of fasteners therein.

9. The post of claim 8 further comprising a spade attachable to the post, said spade comprising a rigid spade sheet and at least one slug element affixed to said spade sheet and retainably insertable into said slot between said flanges for stabilizing said post in loose soil, said least one slug element engaging one of said spacer slugs to limit upward sliding movement of the spade along the post while being driven into the soil.

10. A fence post comprising a three sided tubular channel of triangular cross section, one of said sides having two longitudinal extending inturned normally spaced apart flanges defining therebetween a continuous slot dividing said one side, said slot being open to the interior of the post for receiving fasteners of cross sectional width greater than the spacing of said normal spacing of said flanges, said fasteners being retained therebetween by clamping action resulting from resilient spreading apart of the other two sides at a common angle, said flanges extending from a slot entry at said one side and terminate each in an inner flange end, said flanges having opposing flange faces concavely curved intermediate said slot entry and said flange ends, said flange ends curving slightly towards each other so as to present relatively sharp edges for biting into a fastener driven between said flanges, said flange faces also having convexly curved gripping surfaces near said slot entry for holding the fastener against lateral movement within said slot;

a plurality of spacer slugs fixed between and to said flanges at longitudinally spaced locations for preventing twisting of the post and limiting distortion of said slot due to insertion of fasteners therein; and a spade attacheable to the post, said spade comprising a rigid spade sheet and at least one slug element affixed to said spade sheet and retainably insertable into said slot between said flanges for stabilizing said post in loose soil, said least one slug element engaging one of said spacer slugs to limit upward sliding movement of the spade along the post while being driven into the soil.

* * * * *